US008393315B2

(12) United States Patent
Ruppel et al.

(10) Patent No.: US 8,393,315 B2
(45) Date of Patent: Mar. 12, 2013

(54) CRANK CASE VENTILATOR

(75) Inventors: Stefan Ruppel, Heidelberg (DE); Yakup Özkaya, Kornwestheim (DE)

(73) Assignee: Mahle International GmbH (DE)

( * ) Notice: Subject to any disclaimer, the term of this patent is extended or adjusted under 35 U.S.C. 154(b) by 500 days.

(21) Appl. No.: 12/517,991

(22) PCT Filed: Dec. 6, 2007

(86) PCT No.: PCT/EP2007/063477

§ 371 (c)(1),
(2), (4) Date: Jun. 5, 2009

(87) PCT Pub. No.: WO2008/068320

PCT Pub. Date: Jun. 12, 2008

(65) Prior Publication Data

US 2010/0313830 A1 Dec. 16, 2010

(30) Foreign Application Priority Data

Dec. 7, 2006 (DE) ..... 10 2006 058 072

(51) Int. Cl.
*F01M 13/02* (2006.01)

(52) U.S. Cl. ..... 123/574; 123/572; 123/573; 123/41.86

(58) Field of Classification Search ..... 123/41.86, 123/572–574

See application file for complete search history.

(56) References Cited

U.S. PATENT DOCUMENTS 3,825,031 A * 7/1974 Dolfi, Sr. ..... 137/480
3,880,130 A * 4/1975 Hecht ..... 123/574
4,686,952 A * 8/1987 Zeigler et al. ..... 123/572
5,228,424 A * 7/1993 Collins ..... 123/574
5,233,910 A * 8/1993 Laichinger et al. ..... 91/444

(Continued)

FOREIGN PATENT DOCUMENTS

DE 2112280 9/1972
DE 10043796 3/2002

(Continued)

OTHER PUBLICATIONS

European Search report issued for EP-07847945.8.

(Continued)

*Primary Examiner* — Nathaniel Wiehe
*Assistant Examiner* — Tea Holbrook
(74) *Attorney, Agent, or Firm* — Rader, Fishman & Grauer PLLC

(57) ABSTRACT

The present invention relates to a ventilation device (5) for ventilating a crankcase (6) of an internal combustion engine (1), particularly in a motor vehicle, comprising a ventilation line (26), which is connected at the input side to the crankcase (6) of the internal combustion engine (1) in the mounted state, and which is connected at the output side to a fresh gas line (3) feeding fresh gas to the internal combustion engine (1), a ventilation line (27), which in the mounted state is connected to the fresh gas line (3) at the input side and to the crankcase (6) at the output side. A separator (28) is arranged in the ventilation line (26) to remove pollution from the gas that is discharged from the crankcase (6) and a pressure valve (3) is arranged in the ventilation line (26) to control the gas volume discharged from the crankcase (6). In order to increase the smoothness of running of the internal combustion engine (1) in idle, the ventilation device (5) comprises a locking device (37) for locking the ventilation line (27).

19 Claims, 4 Drawing Sheets

U.S. PATENT DOCUMENTS

Figure 1:
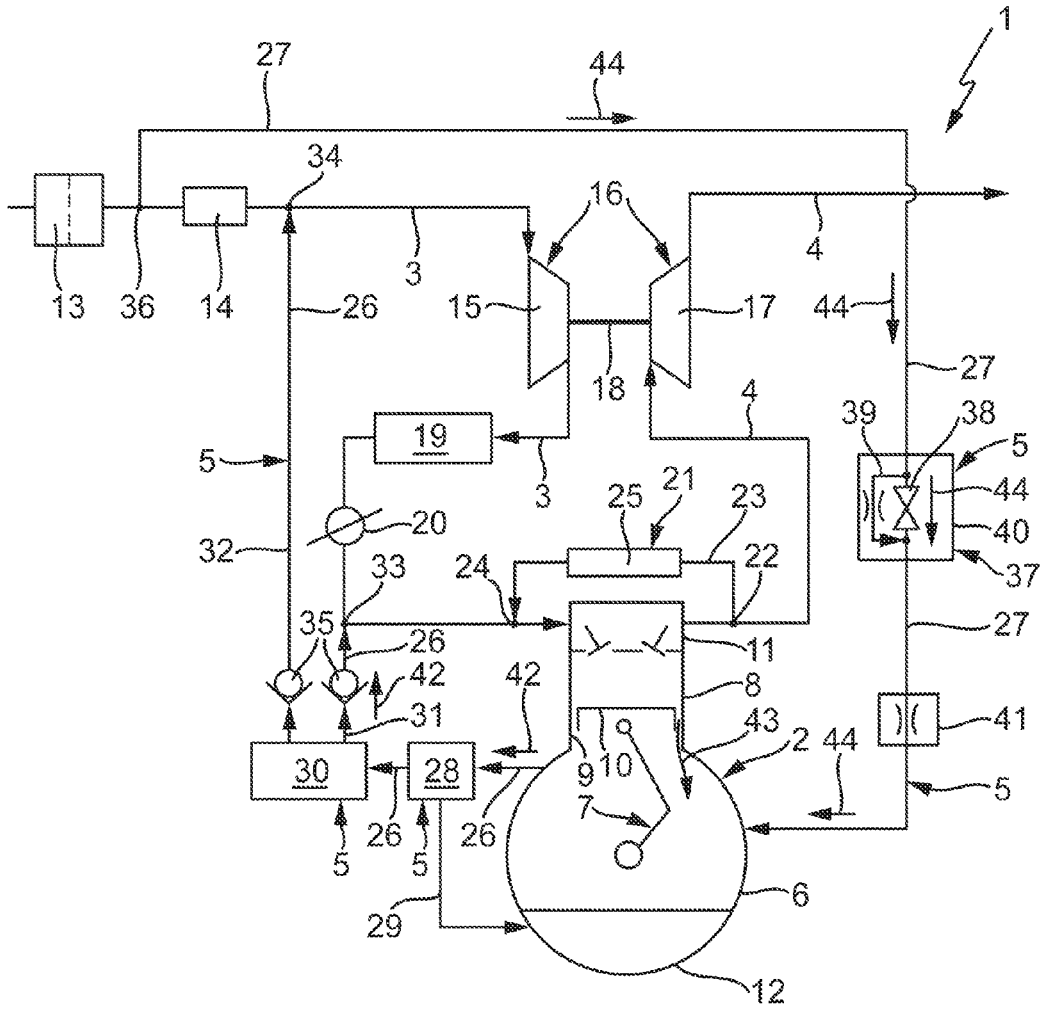

| | | | | |
|---|---|---|---|---|
| 5,714,683 | A * | 2/1998 | Maloney | 73/114.33 |
| 5,964,207 | A * | 10/1999 | Clauss et al. | 123/572 |
| 6,000,421 | A * | 12/1999 | Huemer et al. | 137/110 |
| 6,422,191 | B1 * | 7/2002 | Braun et al. | 123/184.21 |
| 7,100,587 | B2 * | 9/2006 | Ahlborn et al. | 123/572 |
| 7,387,109 | B2 * | 6/2008 | Rembold et al. | 123/446 |
| 2001/0022175 | A1 * | 9/2001 | Moren | 123/572 |
| 2003/0070662 | A1 * | 4/2003 | Kim | 123/572 |
| 2005/0022795 | A1 * | 2/2005 | Beyer et al. | 123/516 |
| 2008/0201062 | A1 * | 8/2008 | Herz et al. | 701/103 |

FOREIGN PATENT DOCUMENTS

| | | | |
|---|---|---|---|
| DE | 10153120 | | 9/2002 |
| DE | 10320857 | | 11/2004 |
| DE | 10323265 | | 12/2004 |
| DE | 202004011882 | | 1/2006 |
| DE | 202005003462 | | 7/2006 |
| DE | 102005020442 | | 11/2006 |
| DE | 202006009537 | | 7/2007 |
| EP | 1135094 | | 9/2001 |
| EP | 1411216 | | 4/2004 |
| EP | 1630367 | | 8/2004 |
| EP | 2034142 | | 3/2009 |
| JP | 56 086340 | U | 7/1981 |
| JP | 04292516 | A | 10/1992 |
| JP | 05-87213 | | 11/1993 |
| JP | 06129226 | | 5/1994 |
| JP | 09144713 | A * | 6/1997 |
| JP | 2006300276 | A * | 11/2006 |
| WO | WO-01/92690 | | 12/2001 |
| WO | WO-02/070871 | | 9/2002 |
| WO | WO-2006/013006 | | 2/2006 |

OTHER PUBLICATIONS

English abstract for JP-06129226.
English abstract for EP-1135094.
English abstract for EP-2034142.
English abstract for EP-1411216.
English abstract for DE10043796.
English abstract for DE-10153120.
English abstract for DE-102005020442.
English abstract for DE-10320857.
English abstract for DE-10323265.
English abstract for DE-202005003462.
English abstract for EP-1630367.
Meinig, U. et al, Kurbelgehause-Entluftung akuteller und zukunftiger Fahrzeugmotoren In, MTZ Motortechnische Zeitschrift, ISSN 0024-8525, 2004, p. 65, H. 10, S. 768-777, Bild 3e), f).
English translationof JP Office Action for 2009-539762.
English abstract for JP-04-292516.
English abstract JP-05-087213.

* cited by examiner

CRANK CASE VENTILATOR

CROSS-REFERENCES TO RELATED APPLICATION

This application is a National Stage application which claims the benefit of International Application No. PCT/EP2007/063477 filed Dec. 6, 2007, which claims priority based on German Patent Application No. DE 102006058072.9, filed Dec. 7, 2006, both of which are hereby incorporated by reference in their entirety.

The present invention relates to a ventilation device for ventilating a crank case of an internal combustion engine, in particular in a motor vehicle. The invention relates in addition to an operating method for such a crank case ventilation device.

During the operation of an internal combustion engine, namely of a piston engine, so-called blowby gases penetrate into the crank case through leaks between the piston and the cylinders. By means of a ventilation device, these blowby gases are discharged from the crank case and are typically fed into a fresh gas line supplying fresh gas to the internal combustion engine. Typically, the ventilation device comprises a separator which is arranged in a ventilation line discharging blowby gas from the crank case, and by means of which pollutants, preferably oil and oil mist, can be removed from the discharged gas, for example, to feed them back into the crank case. The higher the applied pressure difference, the better such a separator operates. At partial-load of the internal combustion engine, in the fresh air line, in particular downstream of a throttling device, relatively strong negative pressures exist, by means of which an adequately high pressure difference at the separator can be realized. However, the blowby gas volume entering at partial-load into the crank case is relatively small. To still be able to use the high pressure difference for increasing the effectiveness of the separator, it is principally possible to provide the ventilation device with a ventilation line which extracts fresh gas, hence typically air, from the fresh gas line and feeds it into the crank case. Hereby it is possible at partial-load that more gas discharges from the crank case than blowby gas enters into the crank case.

However, it was found that internal combustion engines in which such a ventilation of the crank case is carried out run extremely rough in idle operation. This, on the one hand, is sensed by the respective driver as disturbing and, on the other hand, results in increased consumption and emission values.

The present invention is concerned with the problem to propose for a ventilation device or for an associated operating method, respectively, an improved embodiment which is characterized in particular by an increased running smoothness during the idle operation of the internal combustion engine equipped with the ventilation device.

This problem is solved according to the invention by the subject matters of the independent claims. Advantageous embodiments are subject matter of the dependent claims.

The invention is based on the general idea to considerably reduce, or to deactivate, respectively, or to lock the ventilation provided for the partial-load operation during the idle operation. By means of this measure, the gas volume discharged from the crank case through the ventilation line is considerably reduced, namely to approximately the blowby gas volume entering the crank case. With the reduction of the gas volume discharged through the ventilation line, the effectiveness decreases; however, this is acceptable without any problem since during the idle operation, in any case, only a relatively small blowby gas volume accrues. The reduction of the gas volume discharged from the crank case results in the desired running smoothness of the internal combustion engine during the idle operation.

Here, the invention uses the knowledge that the gas volume discharged from the crank case, fed into the fresh gas line and increased for increasing the effectiveness of the separator, is the reason for the rough engine run of an internal combustion engine with a conventional ventilation device. For such a conventional ventilation device, the gas fed into the fresh gas line through the ventilation line is a relatively high portion of the gas volume fed through the fresh gas line to the internal combustion engine, whereby control systems, which operate with the fresh gas volume fed to the internal combustion engine as command variable, are significantly affected.

By means of the considerable reduction of the gases discharged from the crank case and fed to the fresh gas line as proposed according to the invention, the portion of these gases with respect to the fresh gas volume fed to the internal combustion engine can be considerably reduced. Accordingly, the influence of the gas volume introduced into the fresh gas on the control systems of the internal combustion engine decreases. As a result, the synchronous run of the internal combustion engine becomes steady.

Further important features and advantages of the invention arise from the sub-claims, the drawings, and the associated description of the figures by means of the drawings.

It is to be understood that the aforementioned features and the features yet to be described hereinafter are not applicable only in the respective stated combination, but also in other combinations or on its own without departing from the scope of the present invention.

Preferred exemplary embodiments of the invention are illustrated in the drawings and are explained in the following description in more detail, wherein the same reference numbers refer to the same, or similar, or functionally identical components.

Figure 2:
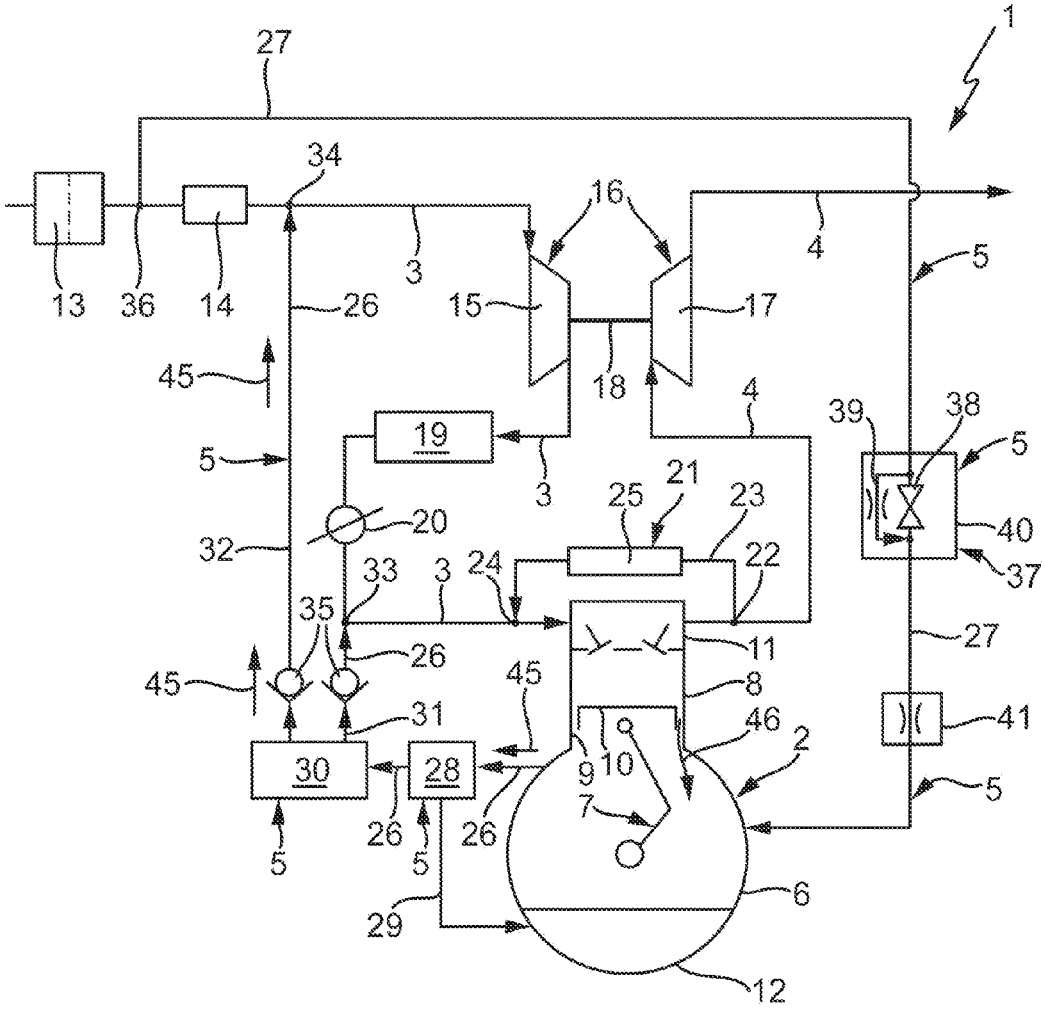
Figure 3:
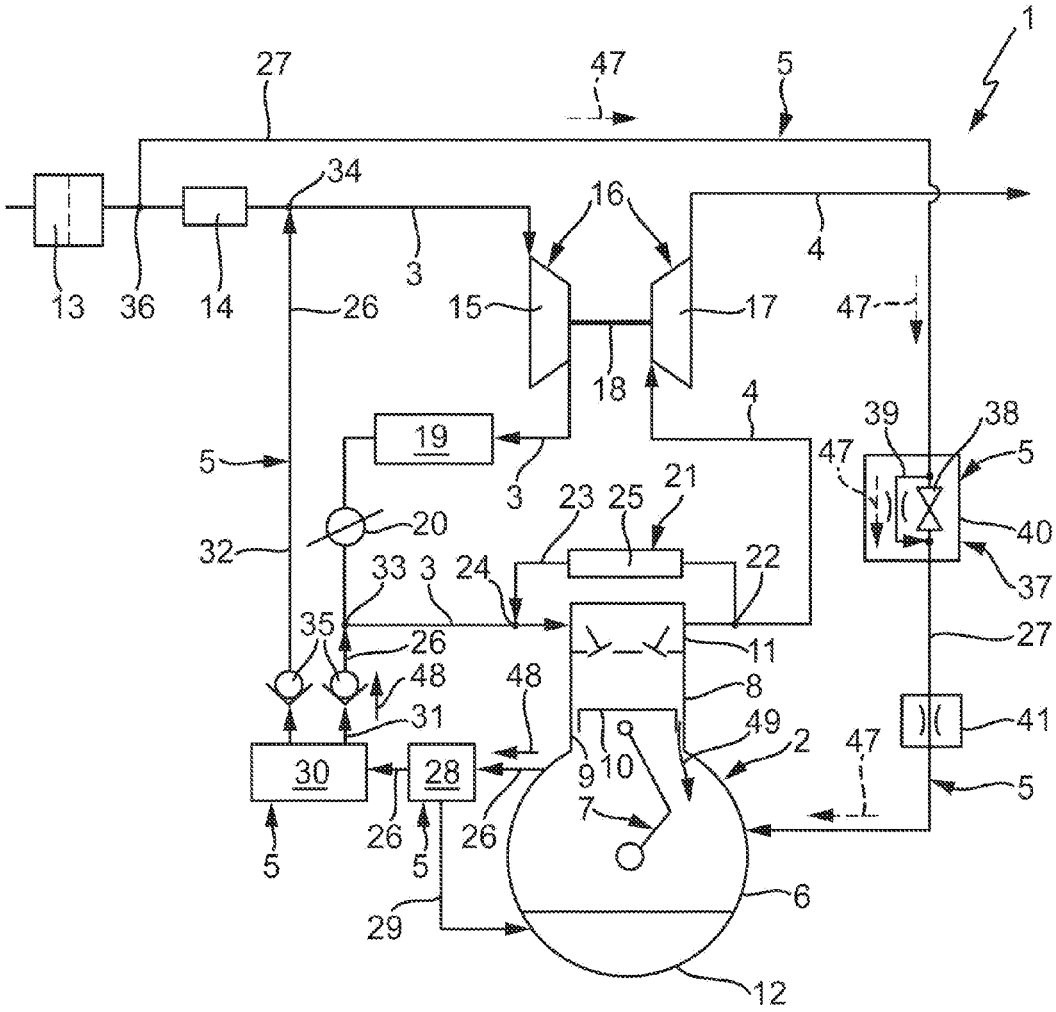

Schematically, in the figures:

FIGS. 1 to 3 each show a greatly simplified diagram-like basic illustration of an internal combustion engine with ventilation device in different operational states of the internal combustion engine, FIGS. 4 to 8 each show greatly simplified basic illustrations of valve devices in different embodiments, namely (a) in an open position and (b) in a closed position.

According to FIGS. 1 to 3, an internal combustion engine which is arranged, for example, in a motor vehicle, comprises an engine block 2, a fresh gas line 3, an exhaust gas line 4, and a ventilation device 5. The engine block 2 comprises here a crank case 6 in which a crank mechanism 7 is accommodated, a cylinder head 8 in which cylinders 9 are arranged for pistons 10 displaceable therein of the internal combustion engine 1, a cylinder head cover 11, and an oil pan 12.

The fresh gas line 3 serves for supplying the internal combustion engine 1 or the engine block 2, respectively, with fresh gas, in particular air, and includes an air filter 13 and, downstream thereof, an air-flow meter 14. In the preferred embodiment shown here, in the fresh gas line 3, in addition, a charging device 15 is arranged by means of which the fresh gas can be brought to an increased pressure level. In the shown example, the charging device 15 concerns the compressor of an exhaust-gas turbocharger 16, the turbine 17 of which is arranged in the exhaust gas line 4 and drives the compressor 15 by means of a common shaft 18. Optionally, downstream of the charging device 15, a charge-air cooler 19 can be arranged in the fresh gas line 3. Principally, the fresh gas line 3 can include a throttling device 20, e.g., a throttle valve, which preferably is arranged downstream of the charging device 15 and—if available—downstream of the charge-air cooler 19.

The exhaust gas line 4 serves in a typical manner for discharging combustion exhaust gas from the engine block 2 of the internal combustion engine 1. Optionally, the internal combustion engine 1 can be equipped with an exhaust gas recirculation device 21 which discharges exhaust gas on the exhaust gas side of the internal combustion engine 1, e.g., from a discharge point 22 arranged at the exhaust gas line 4, and recirculates it by means of an exhaust gas recirculation line 23 to the fresh gas side of the internal combustion engine 1, e.g., by means of an inlet point 24 arranged at the fresh gas line 3. In this exhaust gas recirculation line 23, an exhaust gas recirculation cooler 25 can be arranged.

The ventilation device 5 serves for ventilation of the crank case 6 and comprises a ventilation line 26 and a ventilation line 27. The ventilation line 26 is connected on the input side with the crank case 6 and is connected with the fresh gas line 3 on the output side. In contrast to that, the ventilation line 27 is connected on the input side with the fresh gas line 3 and is connected on the output side with the crank case 6.

The ventilation device 5 further has a separator 28 which is arranged within the ventilation line 26. The separator 28 is preferably a passively operating inertial separator such as, e.g., a cyclone separator. The separator 28 serves for removing of pollutants, preferably of oil and oil mist, from the gas transported within the ventilation line 26. The pollutants separated in the separator 28 can be recirculated by means of a recirculation line 29, e.g. into the oil pan 12. Furthermore, the ventilation device 5 has a pressure valve 30 which is constructed in such a manner that the gas volume dischargeable from the crank case 6 can be controlled with it. Typically, the pressure valve 30 operates passively, thus dependent on the pressure difference applied thereto.

In the shown exemplary embodiment, the ventilation line 26 branches off from the pressure valve 30 by means of two recirculation branches, namely by means of a first recirculation branch 31 and by means of a second recirculation branch 32. The first recirculation 31 is connected downstream of the charging device 15 with the fresh gas line 3. A corresponding first inlet point is denoted with 33. The first inlet point 33 of the ventilation device 5 is arranged here downstream of the throttling device 20 at the fresh gas line 3. In contrast to that, the second recirculation branch 32 is connected upstream of the charging device 15 with the fresh gas line 3. A corresponding second inlet point 34 is preferably located relatively close to an inlet of the charging device 15 to reduce line losses. In any case, the second inlet point 34 of the ventilation device 5 is located downstream of the air-flow meter 14 and downstream of the air filter 13. The first recirculation branch 31 as well as the second recirculation branch 32 preferably each include a check valve 35 which opens towards the fresh gas line 3 and locks towards the crank case 6.

The ventilation line 27 serves for ventilation of the crank case 6, thus for taking-in fresh gas into the crank case 6, which said fresh gas is extracted from the fresh gas line 3 for this purpose. For this, an extraction point 36 is located upstream of the second inlet point 34 and upstream of the air-flow meter 14. Advantageously, the extraction point 36 is located downstream of the air filter 13. According to the invention, the ventilation device 5 has a locking device 37 for the ventilation line 27 by means of which the ventilation line 27 can be locked. The locking device 37 is constructed in such a manner that it can be switched between an open position and a closed or locked position. To realize an inexpensive design, intermediate positions, which are specifically adjustable, are not provided. As shown in the FIGS. 1 to 3, this locking device 37 in the form of a valve assembly can be, for example, a lock valve 38 which can be actuated in a suitable manner. For this, this lock valve 38 is arranged within the ventilation line 27.

Advantageously, the ventilation line 27 is provided with a throttled bypass 39 which bypasses the locking device 37. In the shown example, the throttled bypass 39 bypasses the lock valve 38. In this manner, it is ensured that in the locking position of the locking device 37 or in the locking position of the lock valve 38, respectively, fresh gas still can get into the crank case 6 via the ventilation line 27, although, in a throttled, thus reduced amount. This bypass 39 serves for counteracting the generation of a high negative pressure within the crank case 6. In advantageous embodiments of the locking device 37 or the lock valve 38, respectively, said bypass 39 can be integrated into the locking device 37 or into the lock valve 38, respectively. Accordingly, an assembly comprising the bypass 39 and the locking device 37 or the lock valve 38, respectively, is denoted in the FIGS. 1 to 3 with 40.

The ventilation line 27 is advantageously throttled. Hereby, the systematic maintenance of a negative pressure within the crank case 6 can be achieved. In the shown example, the throttling of the ventilation line 27 is realized by means of a throttling device 41.

Optionally, the ventilation line 27 can also be equipped with a check valve which is open towards the crank case 6 and locks in the opposite direction towards the fresh gas line 3.

The ventilation device 5 of the embodiment shown in the FIGS. 1 to 3 operates as follows:

In a partial-load operation of the internal combustion engine 1, the configuration for the ventilation of the crank case 6 as shown in FIG. 1 applies. At partial load, the locking device 37 is in its open position, i.e., the ventilation function is activated. At partial load, the first recirculation branch 31 is activated and the second recirculation branch 32 is deactivated. This is controlled by the significantly higher negative pressure downstream of the throttling device 20. The arrows 42 symbolize the gas volume, which is extracted at partial load via the ventilation line 26 and its first recirculation branch 31 from the crank case 26 and which is fed downstream of the charging device 15 and downstream of the throttling device 20 into the fresh gas line 3. This gas volume 42 is considerably higher than the blowby gas volume, symbolized by an arrow 43, which reaches the crank case 6 at partial load. The difference between the discharged gas volume 42 and the blowby gas volume 43 is provided by a ventilation volume 44, thus a fresh gas volume 44, which is extracted from the fresh gas line 3 via the ventilation line 27 and is fed to the crank case 6. At partial-load operation, a relatively high negative pressure exists downstream of the throttling device 20, whereby it is possible to extract a relatively high gas volume 42 from the crank case 6. The blowby gas volume 43 which accrues depends on the operational state of the internal combustion engine 1, and the fresh gas volume 44 serving for ventilation adapts itself automatically at opened locking device 37. At partial-load operation according to FIG. 1, the ventilation volume 42 corresponds hence to the sum of blowby gas volume 43 and ventilation volume 44.

FIG. 2 shows an internal combustion engine 1 or the ventilation device 5, respectively, at full load of the internal combustion engine 1. At full load, the second recirculation branch 32 is activated while the first recirculation branch 31 is deactivated. The deactivation of the first recirculation branch 31 is carried out by means of the check valve 35 arranged therein and by means of the positive pressure which arises at full load downstream of the charging device 15 and downstream of the throttling device 20.

At full load, the ventilation device 5 can extract now a gas volume 45, which is about the same as the blowby gas volume 46 entering at full load into the crank case 6, from the crank case 6 via the ventilation line 26 and the second recirculation branch 32. Advantageously, the ventilation volume 45 is slightly higher than the blowby gas volume 46 so as to be able to prevent an over-pressure within the crank case 6. Since at full load, the ventilation volume 45 discharged from the crank case 6 is substantially the same as the blowby gas volume 46 entering into the crank case 6, the ventilation line 27 is virtually inactive at full load. For this, however, the locking device 37 does not need to be switched into its locking position. According to FIG. 2, the ventilation volume 45 corresponds approximately to the blowby gas volume 46. Preferably, the pressure valve 30 is configured for the partial-load operation in such a manner that the ventilation volume 42 achieved at partial load is approximately the same as the blowby gas volume 46 according to FIG. 2 achieved at full load.

FIG. 3 now shows a constellation which arises during idle operation of the internal combustion engine 1. Due to the higher amount of negative pressure in idle operation at the first inlet point 33 compared to the second inlet point 34, again the first recirculation branch 31 is active while the second recirculation branch 32 is deactivated. The ventilation function is deactivated. For this, the locking device 37 is switched into its locking position so that virtually no fresh gas can be supplied to the crank case 6 via the ventilation line 27. However, the bypass 39 allows a throttled fresh gas discharge into the crank case 6, if required. This potentially flowing throttled fresh gas volume is indicated in FIG. 3 by means of broken arrows 47. The gas volume discharged from the crank case 6 via the ventilation line 26 and its first recirculation branch 31 is denoted in FIG. 3 with 48. The blowby gas volume entering into the crank case 6 during the idle operation is denoted in FIG. 3 with 49. Advantageously, the pressure valve 30 is designed here in such a manner that it sets the ventilation volume 48 at partial load to a volume which corresponds approximately to the blowby gas volume 49 generated at partial load. This means that at partial load only a relatively small gas volume gets into the fresh gas line 3 via the ventilation device 5. In this manner, the influence of the extraction volume 48 on the control system of the internal combustion engine 1 can be reduced since the portion of the extraction volume 48 with respect to the total gas volume fed to the internal combustion engine 1 is relatively small. In the idle operation according to FIG. 3, the ventilation volume 48 hence corresponds substantially to the blowby gas volume 49.

In the following, a plurality of different embodiments of the locking device 37 is described in more detail with reference to the FIGS. 4 to 8. For this, the individual embodiments are schematized and strictly exemplary without limitation of the generality and without intending to be exhaustive.

Figure 4A:
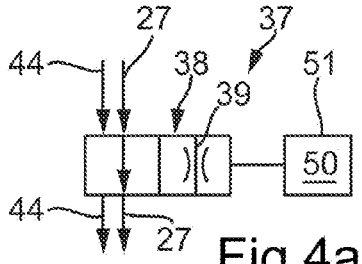
Figure 4B:
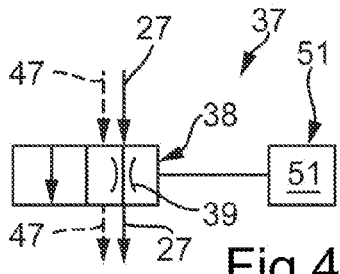

According to FIG. 4, the locking device 37 can be formed by means of a lock valve 38 and can be drive-connected with an actuator 50 for its actuation. The actuator 50 is, for example, an electric actuator 51 which is connected with a not-shown control device, wherein the control device knows the respective load state of the internal combustion engine 1. For example, the control device is an engine control device for operating the internal combustion engine 1. FIG. 4*a* shows the open position while FIG. 4*b* shows the closed position.

Figure 5A:
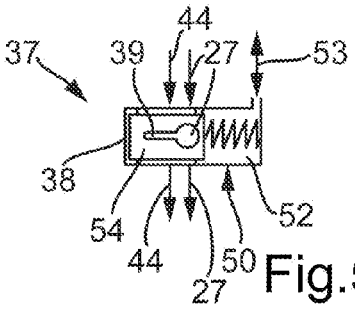
Figure 5B:
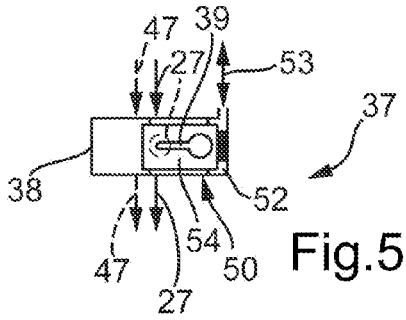

In the embodiment shown in FIG. 5, an actuator 50 is provided again which is realized here by means of a pneumatic actuator 52. The pneumatic actuator 52, indicated by a double arrow 53, is connected with a negative-pressure source which generates a negative pressure upon reaching the idle state, wherein the negative pressure is sufficient to switch a valve member 54 from the open position shown in FIG. 5*a* to the closed position shown in FIG. 5*b*. Here, the valve member 54 is designed exemplary as a slide valve. In particular, the pneumatic actuator 52 can be connected downstream of the throttling device 20 via its operative connection 53 to the fresh gas line 3, in particular to the first inlet point 33.

Figure 6A:
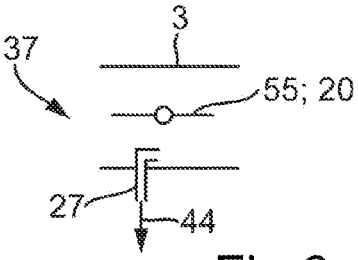
Figure 6B:
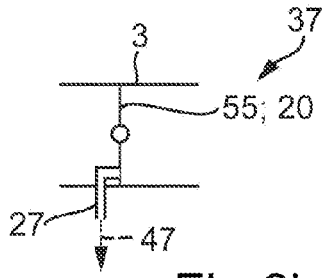

In the embodiment shown in FIG. 6, the ventilation line 27 interacts on the input side with a flap 55 which, in particular, can be the throttling device 20 of the fresh gas line 3. In the open position shown in FIG. 6*a*, an inlet of the ventilation line 27 is fully open so that the ventilation volume 44 can be sucked in. In FIG. 6*b*, the locking position of the locking device 37 is shown. It is clearly recognizable that the ventilation line 27 is closed by the flap 55. By means of controlled leakages which form the bypass 39, only the throttled ventilation volume 47 can be sucked in.

Figure 7A:
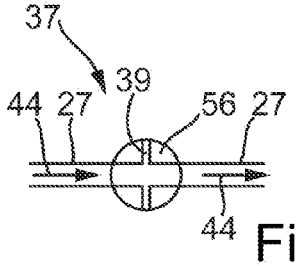
Figure 7B:
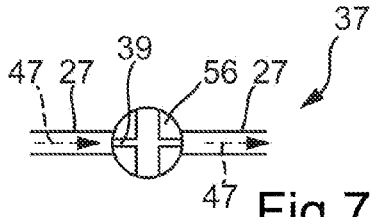

In the embodiment shown in FIG. 7, the locking device 37 or the lock valve 38, respectively, is realized by means of a rotary valve 56 which, in the open position shown in FIG. 7*a*, activates an unthrottled passage, while, in the locking position shown in FIG. 7*b*, it activates a throttled passage, hence the bypass 39. The rotary valve 56 can be, for example, drive-coupled with the throttle device 20 which is preferably designed as a throttle flap, whereby a displacement of the rotary valve 56 can be achieved which depends on the load state of the internal combustion engine 1.

Figure 8A:
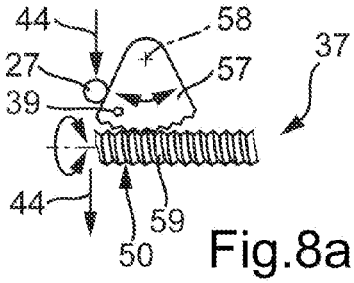
Figure 8B:
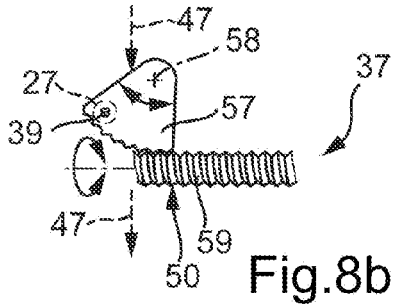

In the embodiment shown in FIG. 8, the locking device 37 or the lock valve 38, respectively, has a pivoting slide valve 57 which is supported pivotably displaceable about a pivot axis 58. On the pivoting slide valve 57, a through-hole can be formed which serves as a throttled bypass 39. The pivoting slide valve 57, for example, is drive-coupled by means of a gearing with a component 59 which can be part of variable valve drive, the rest of which is not shown. Such a variable valve drive is actuated load-dependent. Accordingly, said component 59 serves as an actuator 50 which actuates the pivoting slide valve 57 depending on the load state. In the open position shown in FIG. 8*a*, the ventilation line 27 is fully open. In the locking position shown in FIG. 8*b*, the pivoting slide valve 57 is fully pivoted into the cross-section of the ventilation line 27. Preferably, this locking position for the pivoting slide valve 57 is selected such that the through hole forming the bypass 39 is located within the cross-section of the ventilation line 27.

The invention claimed is:

1. A ventilation device for ventilating a crank case of an internal combustion engine, comprising:

a first ventilation line connected to the crank case on a first input side and connected to a fresh gas line on a first output side, the fresh gas line selectively feeding a fresh gas to the internal combustion engine;

a second ventilation line connected to the fresh gas line on a second input side and connected to the crank case on a second output side;

a separator arranged within the first ventilation line to reduce pollution from a gas discharged from the crank case;

a pressure valve arranged within the first ventilation line to control a gas volume discharged from the crank case;

a valve assembly for locking the second ventilation line; and a throttled bypass configured in the second ventilation line to bypass the valve assembly, allowing the fresh gas into the crank case at a reduced volume.

2. The ventilation device according to claim 1, wherein the valve assembly is a lock valve arranged within the second ventilation line.

3. The ventilation device according to claim 2, wherein the throttled bypass is configured to bypass the lock valve.

4. The ventilation device according to claim 3, wherein the throttled bypass is integrated into at least one of one of the valve assembly and the lock valve.

5. The ventilation device according to claim 2, wherein actuation of the valve assembly is drive-connected with an actuator which is actuated depending on a load state of the internal combustion engine.

6. The ventilation device according to claim 5, wherein the actuator is a member of at least one of the following groups:

i. an electric actuator connected with a control device which knows the load state, ii. a pneumatic actuator connected with the fresh gas line, iii. a throttling device arranged within the fresh gas line, and iv. a component of a variable valve drive of the internal combustion engine.

7. The ventilation device according to claim 2, further comprising: a charging device configured within the fresh gas line, the charging device is arranged for increasing the fresh gas pressure, wherein the first ventilation line has on the first output side a first recirculation branch which is connected downstream of the charging device to the fresh gas line, and wherein the first ventilation line has on the first output side a second recirculation branch which is connected upstream of the charging device to the fresh gas line.

8. The ventilation device according to claim 2, wherein the second ventilation line is at least one of throttled and includes a throttling device.

9. The ventilation device according to claim 1, wherein the bypass is integrated into the valve assembly.

10. The ventilation device according to claim 1, wherein actuation of the valve assembly is drive-connected with an actuator which is actuated depending on a load state of the internal combustion engine.

11. The ventilation device according to claim 10, wherein the actuator is a member of at least one of the following groups:

i. an electric actuator connected with a control device which knows the load state, ii. a pneumatic actuator connected with the fresh gas line, iii. a throttling device arranged within the fresh gas line, and iv. a component of a variable valve drive of the internal combustion engine.

12. The ventilation device according to claim 1, further comprising: a charging device configured within the fresh gas line, the charging device is arranged for increasing the fresh gas pressure, wherein the first ventilation line has on the first output side a first recirculation branch which is connected downstream of the charging device to the fresh gas line, and wherein the first ventilation line has on the first output side a second recirculation branch which is connected upstream of the charging device to the fresh gas line.

13. The ventilation device according to claim 1, wherein the second ventilation line is at least one of throttled and includes a throttling device.

14. The ventilation device according to claim 1, wherein actuation of the valve assembly is drive-connected with an actuator which is actuated depending on a load state of the internal combustion engine.

15. The ventilation device according to claim 14, wherein the actuator is a member of at least one of the following groups:

i. an electric actuator connected with a control device which knows the load state, ii. a pneumatic actuator connected with the fresh gas line, iii. a throttling device arranged within the fresh gas line, and iv. a component of a variable valve drive of the internal combustion engine.

16. A method for operating a ventilation device for ventilating a crank case of an internal combustion engine, comprising:

including a ventilation line with the ventilation device, the ventilation line including a first ventilation line connected on a first input side to the crank case and on a first output side to a fresh gas line feeding fresh gas to the internal combustion engine, and the ventilation line including a second ventilation line, which is connected on a second input side to the fresh gas line and on a second output side to the crank case;

discharging more gas at partial load of the internal combustion engine by the first ventilation line from the crank case as blowby gas enters into the crank case, wherein missing gas is fed to the crank case by the second ventilation line;

discharging in idle of the internal combustion engine about the same amount of gas from the crank case by the first ventilation line as blowby gas enters into the crank case; and allowing the fresh gas into the crank case at a reduced volume by bypassing a second ventilation line valve assembly with a throttled bypass configured in the second ventilation line.

17. The method according to claim 16, wherein for reducing the gas volume discharged from the crank case by the ventilation line to a blowby gas volume entering the crank case, the second ventilation line is locked.

18. The method according to claim 16, wherein at full load of the internal combustion engine about the same amount of gas is discharged by the first ventilation line from the crank case as blowby gas enters into the crank case.

19. The method according to claim 16, wherein the gas volume discharged at partial load by the first ventilation line from the crank case corresponds approximately to a blowby gas volume entering the crank case at full load of the internal combustion engine.

* * * * *